United States Patent [19]

Coleman

[11] Patent Number: 4,640,300

[45] Date of Patent: Feb. 3, 1987

[54] HIGH-PRESSURE WATER-JET STRIPPING OF TOBACCO

[75] Inventor: G. A. John Coleman, Richmond, Va.

[73] Assignee: Universal Leaf Tobacco Company, Incorporated, Richmond, Va.

[21] Appl. No.: 682,772

[22] Filed: Dec. 17, 1984

[51] Int. Cl.[4] ..... A24B 5/04; A24B 5/06

[52] U.S. Cl. ..... 131/318

[58] Field of Search ..... 131/318

[56] References Cited

FOREIGN PATENT DOCUMENTS 0816554 7/1959 United Kingdom ..... 131/318

*Primary Examiner*—V. Millin

*Attorney, Agent, or Firm*—Cushman, Darby & Cushman

[57] ABSTRACT

A tobacco stripping system capable of rapid high volume production, comprises a set of high pressure fluid jet nozzles for cutting the leaves into strips. The system also includes conveyor devices for transporting the leaves to and away from the nozzles.

10 Claims, 3 Drawing Figures

HIGH-PRESSURE WATER-JET STRIPPING OF TOBACCO

FIELD OF THE INVENTION

The present invention is directed to a method and apparatus for rapid and high volume stripping of tobacco leaves. More specifically, the process and apparatus of the present invention uses high-pressure fluid jets to rapidly cut a high volume of tobacco leaves into strips.

BACKGROUND OF THE INVENTION

The tobacco industry for sometime has needed to cut tobacco leaves into approximately one and one-half inch strips at a high rate of speed. Conventional threshing machines are not capable of producing uniform one and one-half inch strips of tobacco. Such one and one-half inch strips are particularly advantageous in the cigarette industry where they are used to help bind the smaller threshed components into a closely packed cigarette. Although a number of prior art tobacco stripping machines and methods are known, none of them are capable of rapid high volume production.

For example, U.S. Pat. Nos. 671,845 and 671,846 to Whitaker, respectively, disclose a process and apparatus for separating the portions of leaves from their stems. In the Whitaker patents, a rotary knife is used to sever the veins of the leaves to facilitate leaf removal from the stems. The tobacco leaves must be fed individually and oriented correctly so that the leave are gripped at their base and dragged across a nozzle which by air pressure removes the laminae from the stem. The disadvantages of the Whitaker systems, are as described above, namely that they are incapable of high production volumes. This results because the leaves must be properly oriented with their bases facing the machinery so that they can be individually gripped and pulled across the rotary knife and the air pressure nozzle.

Hudson in U.S. Pat. Nos. 667,317 and 667,319, respectively, discloses a process and apparatus for separating tobacco leaves from their stems which employs water as the stripping medium. The water is under low pressure and the entire leaf must be immersed. Thus, the Hudson patents disclose systems which also are incapable of rapid high volume production. However, the complete immersion of a tobacco leaf in order to strip the laminae from the stems is also disadvantageous in that it results in staining of the leaf, thereby reducing its quality and value in the marketplace.

Other prior art steming devices include U.S. Pat. No. 667,354 to Whitaker, U.S. Pat. No. 671,846 to Whitaker, U.S. Pat. No. 691,196 to Spencer et al, U.S. Pat. No. 741,863 to Whitaker and U.S. Pat. No. 1,235,722 to Peper. All of these systems similarly to those described in detail above, suffer from the same disadvantage in that they are incapable of rapid high volume production of stripped tobacco leaves. All these patents depend on the large surface area of the laminae and the relatively low shear resistance as a prerequisite for removal. The laminae is effectively torn away from the stem.

SUMMARY OF THE INVENTION

The present invention overcomes the disadvantages of the prior art systems by providing a tobacco stripping system capable of rapid high volume production. In the present invention, alignment of the tobacco leaves is unimportant. Furthermore, neither the stem nor leaf in the present invention is gripped in any way, and high-pressure fluid or water jets acting as very sharp, thin knives slice the leaves into strips, the width of the strips being determined by the spacing of the fluid or water jet nozzles. The high-pressure fluid jets are conventional types such as the high-pressure water jets available from Flow Systems, Inc. Accordingly, there is very little force exerted on the leaf and almost no wetting of the leaf laminae. As a result, the end product produced by the present invention consists of strips of pure laminae and stems with strips of laminae attached, the latter of which can be subsequently threshed in the conventional way.

Although the leaf can be presented to the fluid jet nozzles in any random orientation it is advantageous if the stem is either facing towards the nozzles or away from the nozzles as the tobacco leaf is conveyed to the nozzles, there are various methods of doing this rapidly. One such system for orienting the leaves with their stems facing towards or away from the nozzles is available from Technical Development Corporation (TDC).

Accordingly, the configuration of the present invention which accomplishes a rapid high volume production rate of tobacco stripping includes a tobacco leaf feeding device, which can include a leaf orientation device for orienting the leaves in a specific way (i.e., stems facing towards or away from the nozzles), a plurality of fluid jet nozzles for cutting the tobacco into strips, a first tobacco conveying means for receiving tobacco leaves from the tobacco leaf feeding devices and transporting them to the plurality of fluid jet nozzles, a pressure pad having an opening therethrough so that the plurality of tobacco leaves when transported across the pressure pad can be cut into strips by the fluid jet nozzles. The fluid from the nozzles passing through the opening in the pressure pad, through a silencer disposed beneath the pressure pad, to reduce the noise level, and into a catch pot immediately beneath the silencer. A second tobacco conveying means is also provided for receiving the cut strips of tobacco leaves from the pressure pad and transporting them to a system outlet.

Accordingly, the present invention provides an apparatus and method for the rapid high volume production of tobacco leaf strips.

DETAILED DESCRIPTION OF THE INVENTION

Figure 1:
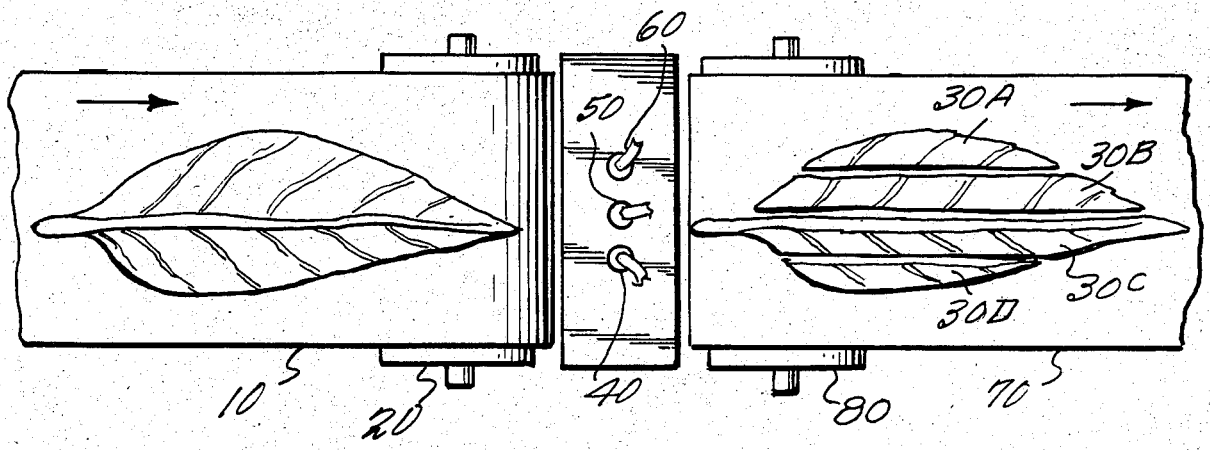
FIG. 1 is a plan view of a portion of the present invention.

FIG. 1 shows a portion of the present invention to be comprised of a first conveyor belt 10 which rotates around a drum 20 and which is used to transport a tobacco leaf 30 to a set of high pressure fluid or water jet nozzles 40, 50, 60. In the preferred embodiment the fluid used in the jet nozzles is water. A second conveyor belt 70 which travels around a drum 80 is used to transport the stripped tobacco leaf, which has been cut into strips 30A, 30B, 30C and 30D from the water jet nozzles, to the outlet of the system. The width of the aforementioned strips 30A, 30B, 30C and 30D is dependent upon the spacing of the water jet nozzles 40, 50, 60 and as has been mentioned above a preferred spacing is approximately one and one-half inches. Accordingly, as shown in FIG. 1, the strips 30A, 30B and 30D are pure laminae strips and the strip 30C includes the stem of the tobacco leaf.

Figure 2:
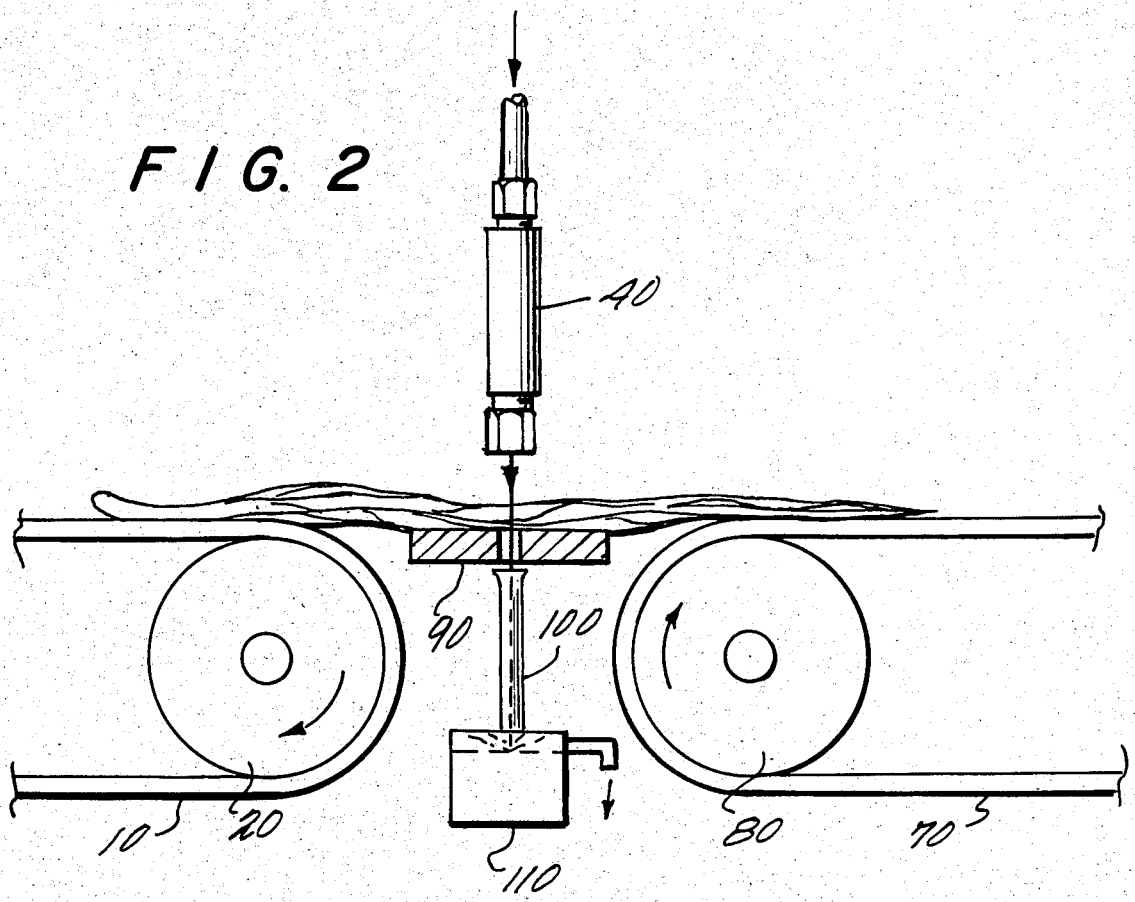
FIG. 2 is a profile view of the present invention as shown in FIG. 1.

FIG. 2 shows the portion of the invention shown in FIG. 1 in profile and further illustrates the pressure pad 90 over which the tobacco leaf is transported by the conveyor belts 10 and 70, the silencer 100 and the catch pot 110. The high pressure water emitted from the nozzle 40 cuts the tobacco leaf into strips as has been described above and the water passes through the pressure pad opening, through the silencer 100 and into the catch pot 110. The catch pot water can be filtered and recycled for reuse in the water jet nozzles, with the residue filtered therefrom used in the tobacco product industry.

Figure 3:
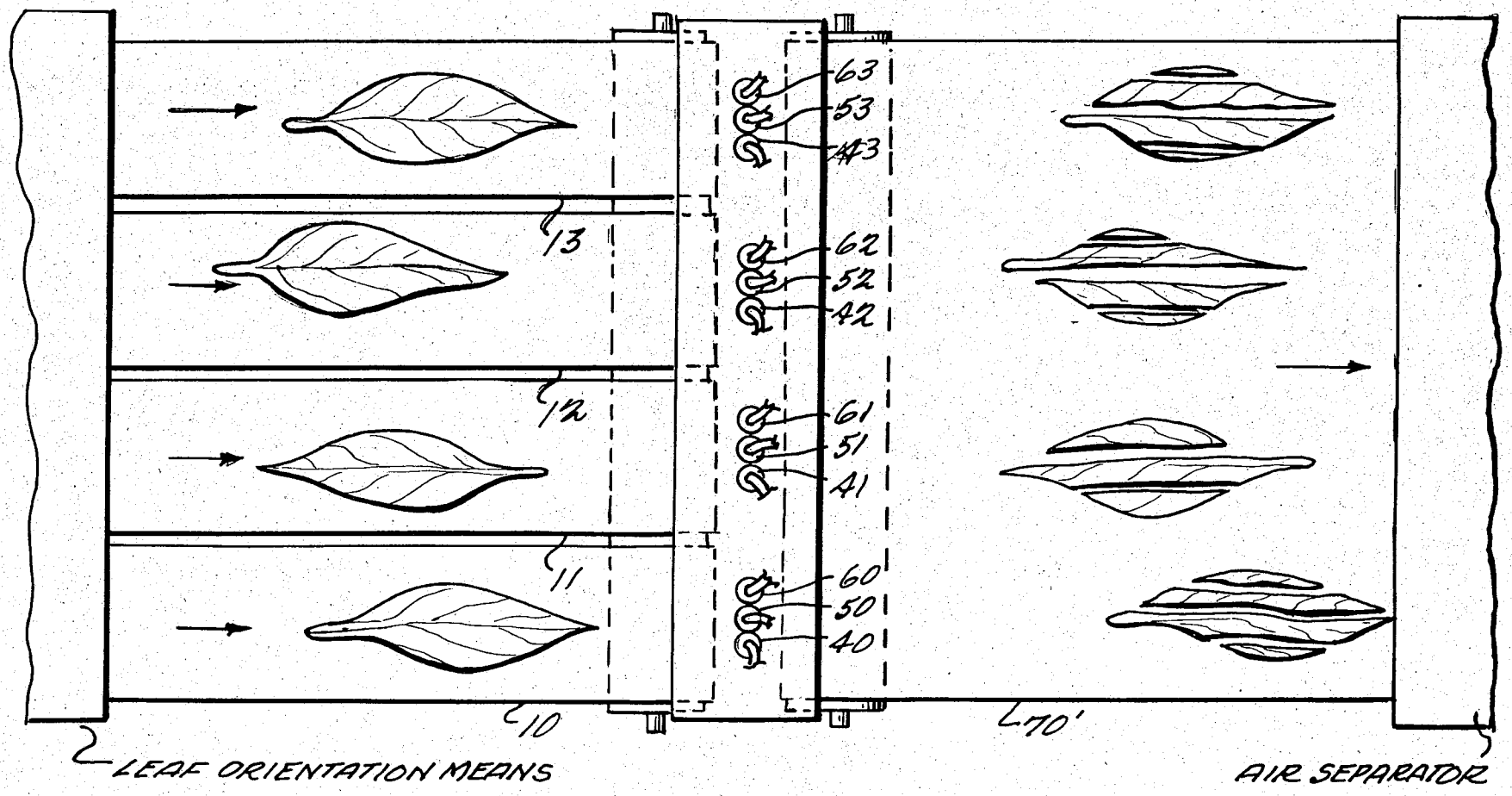
FIG. 3 shows a plan view of the present invention in which the high production volume of stripped tobacco leaves is accomplished.

FIG. 3 shows the present invention in plan view to be comprised of a plurality of high pressure water jet nozzles 40–43, 50–53 and 60–63. Conveyor belts 10–13 are used to transport the tobacco leaves from the tobacco leaf feeding device to the water jet nozzles and a single conveyor belt 70' is used to transport the stripped tobacco leaves to an air separator. The air separator is used to separate the stem-free strips from the strips containing stems.

In FIG. 3, a tobacco leaf feeding device is shown which orients the leaves with their longitudinal axis along the direction of transportation to the water jet nozzles. As shown in the figure the tobacco leaves on conveyor belts 10 and 11 are oriented with their bases facing in opposite directions. Thus, the aligned leaves travel on the conveyors 10–13 in a series of channels, the stems parallel with the channels. However, as noted above, the feeding device need not orient the leaves in this manner, but rather may provide them at any random orientation with respect to the jet nozzles. As mentioned above, when the leaves are transported to the water jet nozzles they exit the conveyors 10–13 and pass over the pressure pad, which is a steel plate with a slot extending along its length at 90° to the direction of the tobacco leaf travel. The series of sapphire tipped nozzles are positioned at about 3 inches above the pressure pad slot and are directed vertically downward. The nozzles are capable of being moved across the pressure pad to thereby vary the distance between adjacent nozzles.

The nozzles are supplied with water at a pressure of up to 55,000 P.S.I. The orifice in the nozzles may vary from 0.004 inches to 0.012 inches. This results in a supersonic jet of water discharging from the nozzle. When the jet strikes a tobacco leaf, it blasts out a portion of the leaf about the same thickness as the jet of water by compressive shearing. As the leaves are propelled across the jet nozzles by means of the conveyors 10–13 in cooperation with the conveyor 70', the water jet nozzles cut the leaves into strips. The mixture of water and tobacco particles passes through the slotted plate into the combination catch pot and silencer. The mixture obtained in the catch pot, as mentioned above may be discarded or filtered to reclaim the tobacco dust.

The apparatus and method herein described and shown is not intended to be limited to merely the details shown and described, since various modifications and structural changes may be made therein without departing from the spirit of the invention and within the scope and range of equivalents of the claims.

For example, in place of the separate conveyors 10–13 a single conveyor belt could be used similarly to the single exit conveyor belt 70'. Furthermore, although the preferred spacing of the jet nozzles has been stated to be one and one-half inches, other spacings are also within the scope of the present invention.

What is claimed is:

1. A tobacco stripping system for cutting a plurality of tobacco leaves into strips, comprising:

tobacco leaf feeding means for feeding said plurality of tobacco leaves to be cut into strips;

first tobacco conveying means for receiving said plurality of tobacco leaves from said tobacco leaf feeding means and transporting said plurality of tobacco leaves along a predetermined path;

a pressure pad having an opening cut therethrough across which said plurality of tobacco leaves are transported after leaving said first tobacco conveying means;

a plurality of liquid jet nozzles positioned above said pressure pad in alignment with said opening, said plurality of liquid jet nozzles generating a fine stream of high pressure liquid which cuts said plurality of tobacco leaves into strips as they are being transported across said pressure pad;

a silencer disposed beneath said pressure pad having one end facing said opening for receiving a mixture of liquid, from said plurality of nozzles, and small particles of tobacco leaves, which results from the strip cutting of said plurality of tobacco leaves;

a catch pot connected to the other end of said silencer for collecting said mixture; and a second tobacco conveying means for receiving said strips of tobacco leaves from said pressure pad and transporting them to a system outlet.

2. A system as claimed in claim 1, wherein said first conveying means comprises a plurality of conveyor belts which collectively define tobacco leaf conveying channels.

3. A system as claimed in claim 1, wherein said plurality of liquid jet nozzles are spaced at one and one-half inch intervals.

4. A system as claimed in claim 1, wherein said pressure pad opening comprises a slot in the longitudinal direction of said pressure pad, said slot being oriented at 90° to said predetermined path.

5. A system as claimed in claim 1, wherein said second tobacco conveying means comprises a conveyor belt.

6. A system as claimed in claim 1, further comprising a separating means for separating tobacco strips without attached stems from tobacco strips with attached stems.

7. A system as claimed in claim 1, wherein said tobacco leaf feeding means includes leaf orientation means for orienting said plurality of tobacco leaves in at least one angular configuration with respect to said predetermined path.

8. A system as claimed in claim 7, wherein said leaf orientation means orients said plurality of tobacco leaves into any one of two positions, a first position having the longitudinal axis of the tobacco leaves aligned along said predetermined path and the stems of the tobacco leaves facing away from said liquid jet nozzles, and a second position having the longitudinal axis of the tobacco leaves aligned along said predetermined path and the stems of the tobacco leaves facing towards said liquid jet nozzles.

9. A method of cutting a plurality of tobacco leaves into strips, said method comprising the steps of:

feeding the tobacco leaves along a predetermined path;

receiving the tobacco leaves at a station comprising a plurality of liquid jet nozzles;

cutting the tobacco leaves received at said station into strips by subjecting them to high-pressure liquid from the plurality of liquid jet nozzles; and separating the strips of tobacco leaves with stems from strips of tobacco leaves without stems.

10. A method of cutting a plurality of tobacco leaves into strips, said method comprising the steps of:

orienting the tobacco leaves in any one of two positions, the first position having the base of the tobacco leaf facing in a tobacco leaf conveying direction and the second position having the base of the tobacco leaf facing opposite to the first position;

conveying the oriented tobacco leaves to a station comprising a plurality of liquid jet nozzles;

cutting the tobacco leaves conveyed to said station into strips by subjecting them to high-pressure liquid from said plurality of liquid jet nozzles; and separating the strips of tobacco leaves with stems from strips of tobacco leaves without stems.

* * * * *